United States Patent [19]

Knell

[11] 4,428,173

[45] Jan. 31, 1984

[54] LOAD CARRYING STRUCTURE AND METHOD OF MANUFACTURE THEREFOR

[75] Inventor: Harvey A. Knell, Yorkville, Ill.

[73] Assignee: Caterpillar Tractor Co., Peoria, Ill.

[21] Appl. No.: 245,236

[22] PCT Filed: Apr. 9, 1980

[86] PCT No.: PCT/US80/00398

§ 371 Date: Apr. 9, 1980

§ 102(e) Date: Apr. 9, 1980

[87] PCT Pub. No.: WO81/02884

PCT Pub. Date: Oct. 15, 1981

[51] Int. Cl.[3] ..... E04C 3/30

[52] U.S. Cl. ..... 52/731; 212/266; 414/722; 228/166; 228/182

[58] Field of Search ..... 52/116, 117, 731; 212/266; 414/722; 228/166, 167, 182

[56] References Cited

U.S. PATENT DOCUMENTS

| | | | |
|---|---|---|---|
| 1,960,557 | 5/1934 | Snyder . | |
| 2,257,386 | 9/1941 | Kempe | 52/116 |
| 2,846,081 | 8/1958 | Moore . | |
| 3,722,864 | 3/1973 | Borer et al. | 52/731 X |
| 3,902,295 | 9/1975 | Yancey | 52/730 |
| 4,034,876 | 7/1977 | Yancey | 414/727 X |
| 4,159,796 | 7/1979 | Braithwaite | 228/151 |
| 4,161,369 | 7/1979 | Moreno | 414/722 |
| 4,193,734 | 3/1980 | Williams | 414/918 X |
| 4,216,895 | 8/1980 | Holmes | 228/166 X |
| 4,293,269 | 10/1981 | Zook | 212/266 X |

*Primary Examiner*—Carl D. Friedman

*Attorney, Agent, or Firm*—William B. Heming

[57] ABSTRACT

A load carrying structure (10) is, for example, the stick (12) of an excavator or another work element having at least three load input locations (70,72,74). In operating the excavator, for example, failure of the stick can occur owing to side, torsional, bending and columnar loading through bucket (16), boom (14), and control element connections (18,20,76) at associated load input locations. A method for making the structure (10) includes connecting top and bottom plates (22,24) and side plates (30,32) which extend outwardly to define respective load input locations (70,74). Other load input locations (72,74,144) are on a box structure (82) formed with the side and top and bottom plates (30,32; 22,24). The structure (10) has a more uniform construction, particularly without weld discontinuities, and resists input forces more effectively owing to the relationship of the load input locations to substantially overcome failures associated with such structures.

22 Claims, 5 Drawing Figures

10
12
22
24
26
28
30
32
34
36
38
40
42
44
46
48
52
56
58
60
62
64
70
72
74
78
80
82
86
88
106
108
110
112
114
116
118
119
120
121
122
124
126
130
132
134
136
137
139
140
142
143
144
148
150
152
154
156
157
158
160
162
164
166
168
170
172
174
176
IV
IV
W1
W2
W3
W4

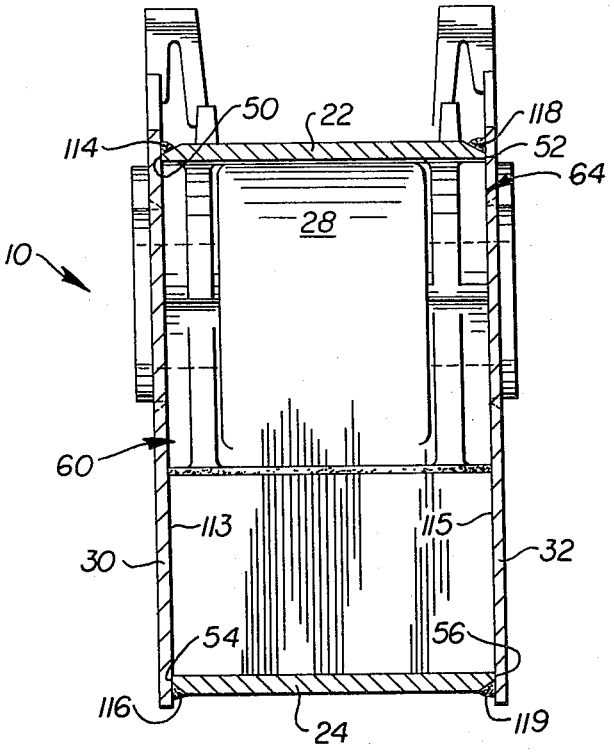
FIG. 4.
FIG. 5.
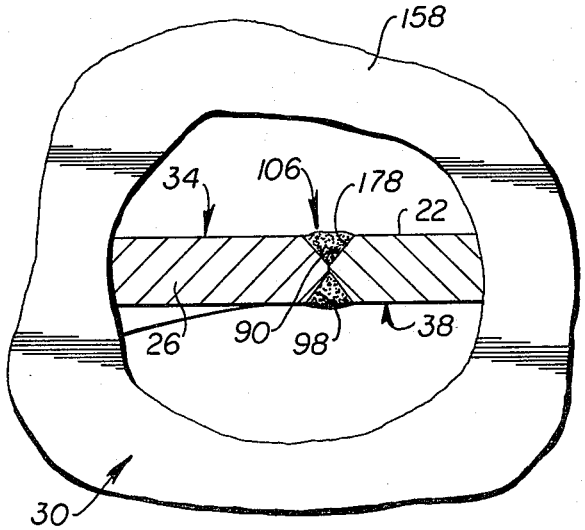

LOAD CARRYING STRUCTURE AND METHOD OF MANUFACTURE THEREFOR

DESCRIPTION

Technical Field

The invention relates to load carrying structures generally of a box-like structure and having preselected load input locations on said structures. More particularly, the invention relates to load carrying structures, such as, for example, the stick of an excavator, which encounter side, torsional, bending and columnar loading.

Background Art

In the use of load carrying structures, it is desirable to carry and distribute loads exerted on the structures to minimize failure of the structure elements. It is also desirable to minimize weight of the structure and to simplify fabrication and inspection as much as possible.

Load carrying structures have preselected load input locations through which various loads on the structure are exerted. In the stick of an excavator, for example, which is typical of such load carrying structures, the preselected load input locations represent the connecting points of the boom, bucket and hydraulic control cylinders to the stick. The stick thus acts as an intermediate link in the control operations of the bucket or other work elements of the excavator. The bucket of the excavator, for example, is often subjected to severe work applications which create high torsional and bending loads on the stick through the load input locations. It will be readily understood that such loads and the possible combinations thereof can cause early failure of a stick, particularly where the design of the stick creates highly localized loading. Thus, each portion, or step of manufacturing, of a load carrying structure is critical to its overall ability to effectively and efficiently carry the particular types of loads which will be encountered. In the excavator this is particularly important as the front load carrying structures need be as lightweight as possible for counterbalancing purposes.

Heretofore, typical stick design has included top and bottom plates and side plates which are fabricated, generally by welding, into a rectangular box-like arrangement. The load input locations, most commonly determined by pin joints with other parts of the excavator, are often defined by castings which provide an area of the structure having increased section properties in a relatively compact space. Such castings have generally been added to the ends of the box structure to define respective connections of the stick control cylinder and of the bucket and bucket linkage. A casting also is commonly added in the middle portion of the stick to define the boom mounting location. Also, the bucket control cylinder is connected to the stick at a tab or extended portion of the side plates adjacent the boom connection. Welding of the various elements of the stick one to the other has been by using weld back-ups which cover the back-up side of the weld and interfere with thorough inspection of the welds as a result.

Constructions of, and methods for, making load carrying structures are disclosed in the following patents. U.S. Pat. Nos. 4,159,796 which issued to Braithwaite on July 3, 1979, and 3,902,295 which issued to Yancey on Sept. 2, 1975, show details of booms used on excavators. U.S. Pat. Nos. 2,846,081 which issued on Aug. 5, 1958, to Moore and 2,257,386 which issued on Sept. 30, 1941, to Kempe disclose load carrying structures as are used on cranes or derricks. U.S. Pat. No. 1,960,557 which issued to Snyder on May 29, 1934, shows details of a pipe fitting for joining two sections of pipe.

In the use of the excavator, loading of the stick varies with the input location as related to the element of the excavator connected to the stick. Loads from the bucket onto the stick include side, torsional, axial and bending loads. For example, the bending loads result from digging or lifting with the bucket. The reaction to such loading forces are primarily taken by the stick at the boom-stick pin (load input) connection, as are the forces from side and torsional loading. The stick is also loaded as a column at its end opposite the bucket, along with stick control cylinder bending loads. The bucket cylinder similarly exerts bending loads on the stick. Additionally, significant torsional and side loading is further created on the stick in response to various conditions of stick operation such as in corner and side loading of the bucket during digging.

The above-mentioned complicated loading can quickly create localized loading conditions on a stick which cause damage at weak points in the design. The position and interconnected relationship of the elements in the load carrying structure thus are critical to satisfactorily carry the load or reaction forces on the stick. For example, the adjoining relationship of a side plate and casting needs to be uniform and properly positioned in the structure to substantially eliminate discontinuities of cross section which tend to produce highly localized stresses. Also, it is desirable to adjoin the elements in a manner which easily and consistently provides uniform weld grooves and constant weld cross section. In this context, both sides of a weld should be visible to eliminate hidden welds and to facilitate visual and ultrasonic inspection throughout the assembly process.

Therefore, it is desirable to design and construct a load carrying structure, such as the stick of an excavator, to optimize location and connection of the elements to carry the loading exerted on the particular portions of the stick. It is also important to simplify assembly and inspection to insure proper construction and operability according to the design parameters.

The present invention is directed to overcoming one or more of the problems as set forth above.

Disclosure of the Invention

In one aspect of the present invention, a load carrying structure has top and bottom plates each connected to first and second side plates. The side plates each extend outwardly from and adjacent to a first end portion of said top and bottom plates. Said structure has first and second preselected load input locations defined on the first and second side plates. A third preselected load input location is defined on the outwardly extending portions of both of the first and second side plates, respectively.

In another aspect of the present invention, a load carrying structure has first and second side plates and top and bottom plates interconnected in a box structure. A first support member is mounted on said box structure and defines a first load input location. A second support member is mounted to said load carrying structure and defines a second load input location. The first and second side plates extending outwardly from the box structure. A third load input location of said structure is defined by said outwardly extending portions of said plates.

In yet another aspect of the present invention, a method is disclosed for making a load carrying structure having first and second support members, top and bottom plates and first and second side plates. The method includes the step of connecting each of the top and bottom plates to both the first and second support members to form a skeleton structure. The first and second side plates are positioned relative to and in contact with the skeleton structure at a location extending outwardly from said skeleton structure and both connected to respective portions of the first and second support members and the top and bottom plates.

The load carrying structure is a work element, such as the stick of an excavator, which has the load input locations for receiving and transmitting through the structure loads applied thereon. The stick, for example, encounters side, torsional, bending and columnar loads during operation of the excavator through connections to the bucket, boom, and bucket and stick control cylinders. Under the high loading of some operations, the loads can cause a failure of the stick. The load input locations as defined are particularly located in the structure relative to elements of the structure to better resist the mode of failure generally associated with loading of the type encountered on the stick of the excavator.

BRIEF DESCRIPTION OF THE DRAWINGS

FIG. 4 is a diagrammatic cross sectional view taken along line IV—IV of FIG. 3; and FIG. 5 is a diagrammatic partial cutaway view taken at line V of FIG. 3.

BEST MODE FOR CARRYING OUT THE INVENTION

Figure 1:
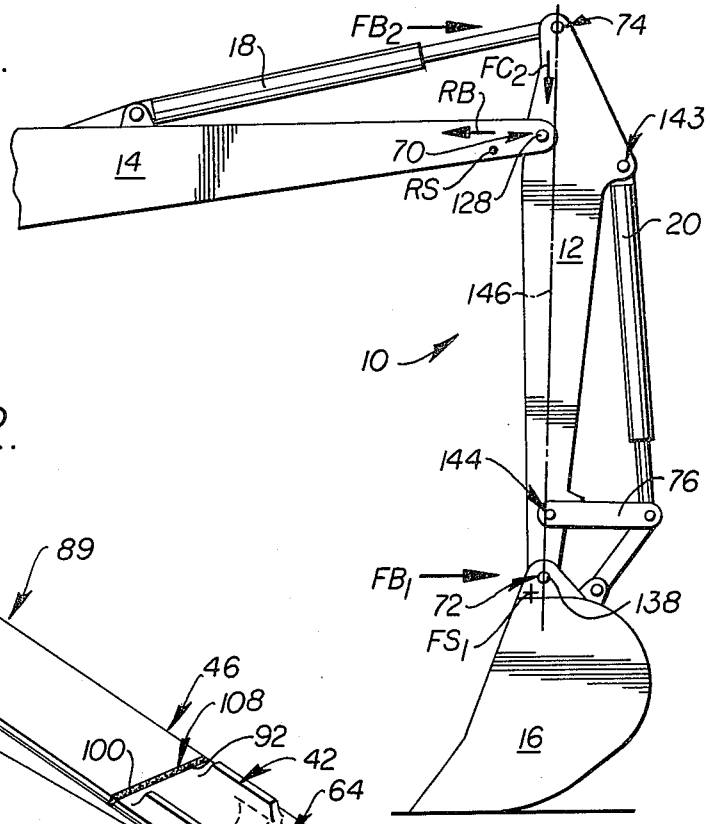
FIG. 1 is a diagrammatic side view showing an embodiment of the present invention represented in a typical environment as a stick on an excavator.

Referring to the drawings, and particularly to FIG. 1, a load carrying structure 10 is shown, for example, as a stick 12 of an excavator (not shown). The excavator, as is known in the art, has a boom 14 and a bucket 16 interconnected to said stick for controllably positioning the bucket by first and second hydraulic cylinders 18,20 to perform work operations of the excavator.

The load carrying structure 10 includes top and bottom plates 22,24, first and second support members 26,28 and first and second side plates 30,32. The first side plate 30 is connected to a first edge portion 50,54 of both the top and bottom plates and, in the embodiment shown, to a first side portion 58,62 of both the first and second support members. The second side plate 32 is connected to a second edge portion 52,56 of both of said top and bottom plates and, as shown, to a second side portion 60,64 of both of said first and second support members. The first and second support members, in the embodiment shown, are thus covered by the first and second side plates. The first support member is connected at a first end portion 34 to a first end portion 38 of the top plate and at a second end portion 36 to a first end portion 40 of the bottom plate. The second support member is also connected at a first end portion 42 to a second end portion 46 of the top plate and at a second end portion 44 to a second end portion 48 of the bottom plate.

Figure 3:
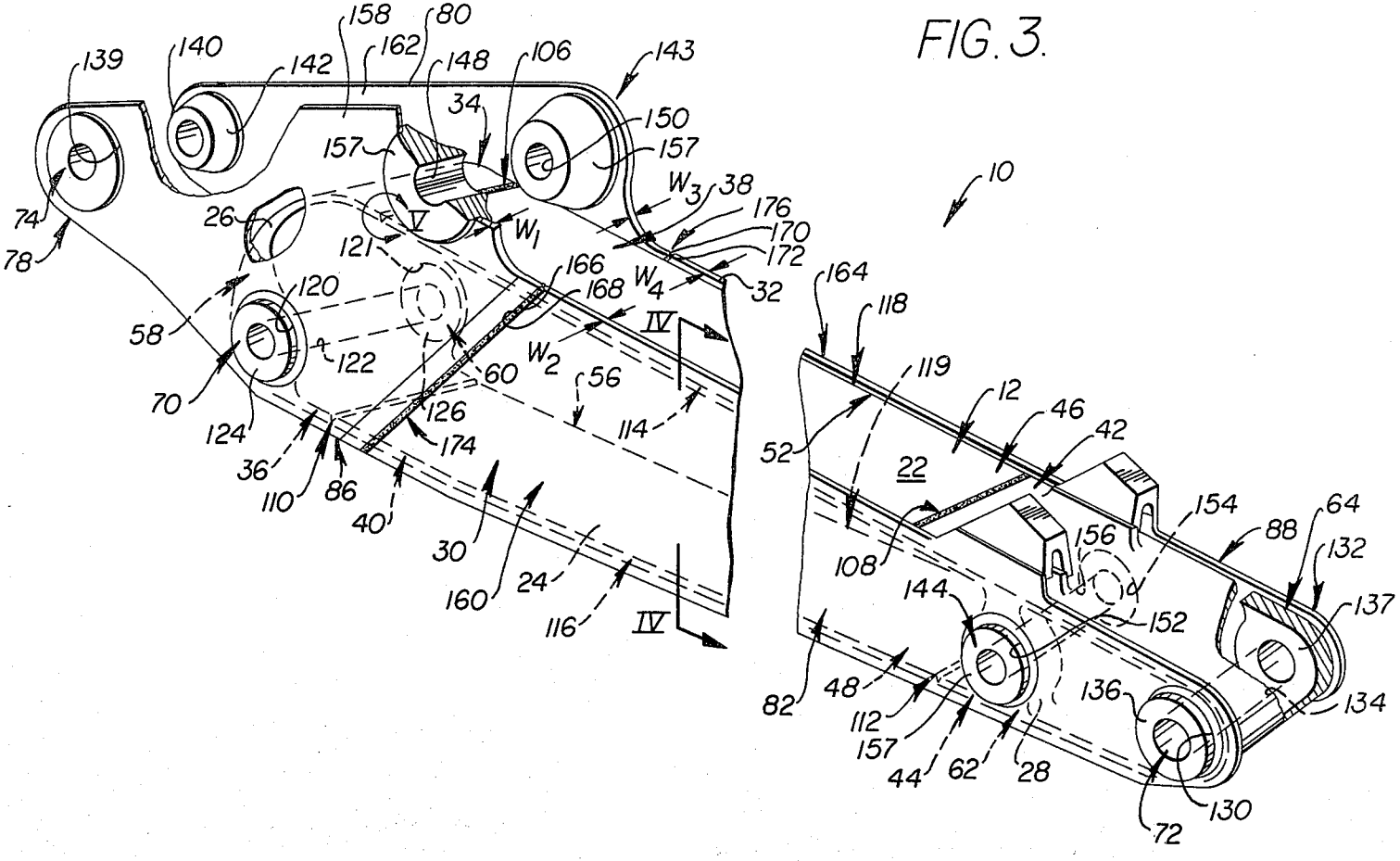
FIG. 3 is a diagrammatic perspective view showing in detail the embodiment of FIG. 1.

The load carrying structure 10 has at least first, second and third preselected load input locations 70,72,74 through which are interconnected associated work elements, such as the boom 14, the first or stick control cylinder 18 and a bucket 16, where the load carrying structure is the stick 12 (FIG. 1). The first and second load input locations are each defined on the first and second side plates 30,32 and with the first and second support members 26,28, located respectively, at said locations. With respect to the third load input location, each of the first and second side plates 30,32 extend outwardly from and adjacent the first support member, with the outwardly extending portions 78,80 thus defined by said side plates being spaced one from the other (as is seen in FIG. 3). The third load input location is defined by preselected portions of both of said outwardly extending portions.

Generally, therefore, the load carrying structure 10 can be seen as having the first and second support members 26,28 mounted on a box structure 82 and defining the first and second load input locations 70,72, respectively, positioned on first and second ends 86,88 of the box structure. The first and second side plates 30,32 extend outwardly from the box structure to define the third load input location 74. Construction details of the load carrying structure 10 will now be discussed and a preferred method for making the load carrying structure will also be detailed in a later portion of the disclosure.

Figure 2:
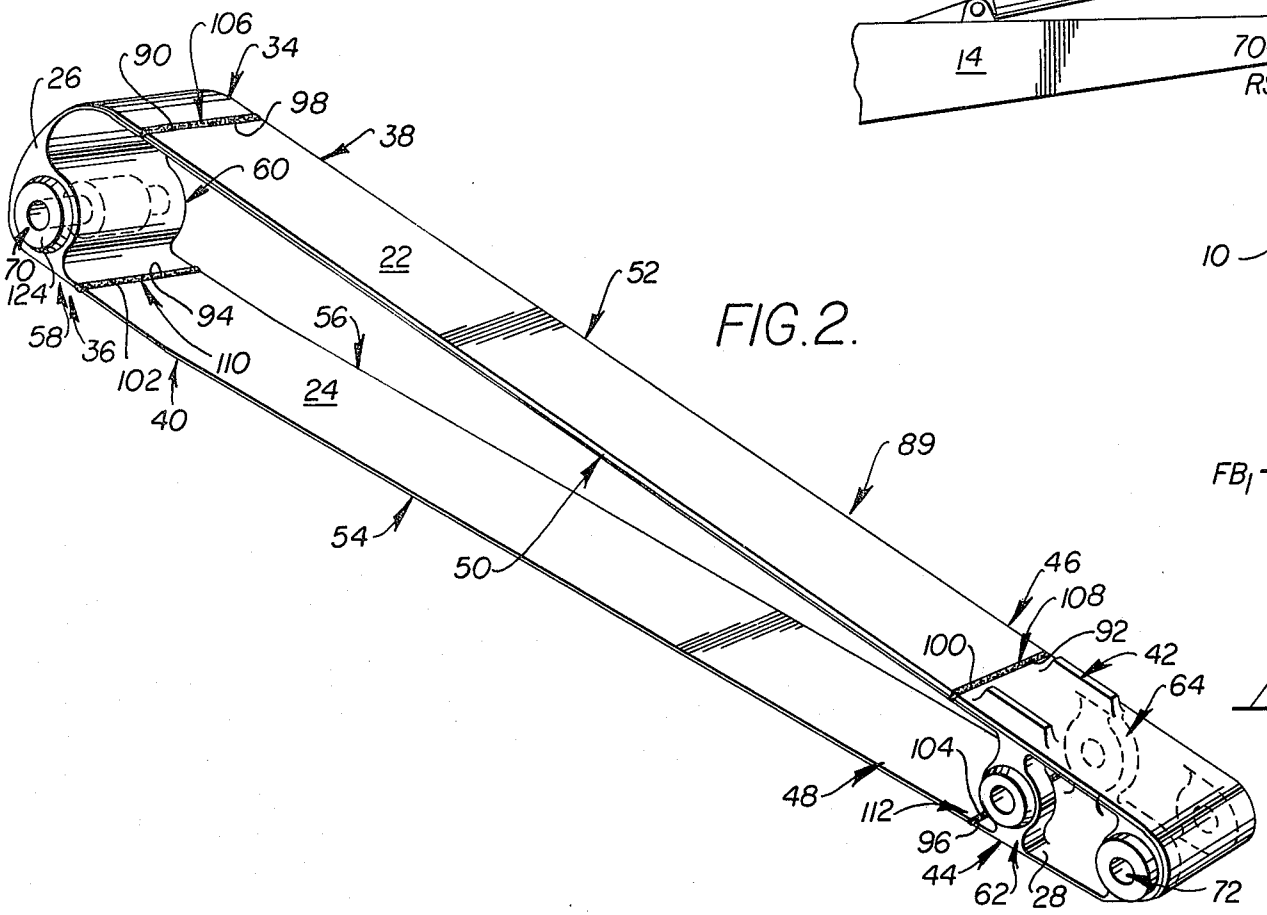
FIG. 2 is a diagrammatic perspective view showing an intermediate step in the construction of the embodiment of FIG. 1.

To form a skeleton assembly 89 which is shown in FIG. 2, respective edges 90,92;94,96 of the first and second end portions 38,46;40,48 of both the top and bottom plates 22,24 are positioned immediately adjacent respective edges 98,100;102,104 of the related connected first and second end portions 34,36;42,44 of the first and second support members 26,28 (see also FIG. 5). Preferably, the edges of said related connected end portions are positioned in abutting relationship one related edge to the other with top and bottom plates and support members being connected one to the other by welds along the related abutting edges.

The edges 90,92 of the top plate 22 are joined by first and second welds 106,108 to the first and second support members 26,28, respectively. The edges 94,96 of the bottom plate are joined by third and fourth welds 110,112 to the first and second support members, respectively. It is desirable that the related edges joined by said first, second, third and fourth welds be positioned in abutting relationship at a location along the skeleton assembly 89 between the first and second load input locations 70,72 as shown.

The first and second side plates 30,32 each have an inner side 113;115 and are positioned in abutting relationship at said inner sides with the first edge portions 50,52 and second edge portions 54,56, respectively, of the top and bottom plates 22,24 (FIG. 4). As seen in FIGS. 3 and 4, the first side plate is connected to the first edge portions of the top and bottom plates by fifth and sixth welds 114,116, respectively, along the related abutting first side and edge portions. The second side plate is connected to the second edge portions of the top and bottom plates by seventh and eighth welds 118,119, respectively, along the related first side and edge portions.

The preselected load input locations 70,72,74 of the load carrying structure 10 shown are represented by pinned connections between the stick 12 and associated elements of the excavator. The load input locations are thus defined as portions of the stick which define openings therein through which pins can be positioned to complete a connection and transmit a load into or from the stick from the various interconnecting elements of the excavator.

For example, the first and second side plates 30,32 each have a first opening 120,121 and the first support member 26 has a related aligned opening 122 (FIG. 3). The first preselected load input location is defined by portions of the first and second side plates defining said respective first openings and by portions of the first support member defining said opening in the first support member. Preferably, the first support member includes first and second support ears 124,126 each positioned in a respective one of the first openings 120,121 of the first and second side plates to further define the first load input location. A pin 128 is positioned through the openings 120,121,122 which in turn provides the connecting link for the boom 14 (FIG. 1). Thus, the portion of a side plate and the first support member defining the first load input location is the perimeter area of the related pin opening which receives the load directed through the pin connection joint onto the load carrying structure.

Similarly, the first and second side plates 30,32 each have a second opening 130,132 and the second support member 28 has a related aligned opening 134. Portions of said side plates and the second support member which define the related respective openings define the second preselected load input location 72. As with the first load input location 70, the second support member preferably includes first and second support ears 136,137 positioned in a respective one of the second openings 130,132. A pin 138 is positioned through the openings defined by the support ears to complete the connection to the bucket control link 76 (FIG. 1).

The third load input location 74 is defined on the outwardly extending portions 78,80 of the first and second side plates 30,32. Each of the outwardly extending portions has a first pin opening 139,140 and the portions of said side plates defining said pin openings define the third load input location similar to the first and second load input locations 70,72. The openings each have a third support ear 141,142 positioned therein.

Further, the stick 12, as shown, has additional fourth and fifth preselected load input locations 143,144 which accommodate additional connections to the excavator elements. The first, second and third load input locations 70,72,74 are positioned generally along a longitudinal axis 146 (FIG. 1) of the stick 12. The fourth load input location is defined by the outwardly extending portions 78,80 of the first and second side plates 30,32 and positioned at a location spaced a preselected distance from the longitudinal axis and generally adjacent the first load input location. The fifth preselected load input location is positioned generally along the longitudinal axis and between the first and second load input locations.

The fourth and fifth load input locations 143,144 are defined similarly to the first, second and third load input locations 70,72,74. Portions of the outwardly extending portions 78,80 of the first and second side plates which define respective openings 148,150 in said side plates determine the fourth load input location. Portions of the first and second side plates and second support member 28 defining respective openings 152,154,156 therein determine the fifth load input location. As discussed previously, support ears 157 determine the portions which establish the load input locations and receive loads onto or transmit loads from the stick 12.

In further detail, the first and second side plates 30,32 and welds of the load carrying structure 10 preferably have specific configurations to optimize load carrying capabilities. The side plates each have first and second plate portions 158,160;162,164 (FIG. 3) with said first plate portions each having an area moment of inertia greater than about the area moment of inertia of the related one of the second plate portions. The first plate portions 158,162 define the first and third load input locations 70,74 and the second plate portions 160,164 have the second load input location 72. In the embodiment shown, the greater area moment of inertia of the first plate portions relative to the related second plate portions is achieved by having the widths $W_1;W_3$ of the first plate portions a preselected amount greater than the widths $W_2;W_4$ of their related second plate portions (FIG. 3).

Each of the plate portions 158,160;162,164 has an edge 166,168;170,172 and the edges of the related first and second plate portions are positioned in abutting relationship one with the other. The first and second plate portions of the first and second side plates 30,32 are connected by ninth and tenth welds 174;176, respectively, along said related abutting locations. The edges are preferably positioned in abutting relationship between the first and second load input locations 70,72 and oriented generally normal to the longitudinal axis 146 as shown.

It is desirable that welds used in the load carrying structure 10 be transverse butt welds. This type of weld is detailed in FIG. 5 which represents the first weld 106 adjoining the first end portion 38 of the top plate 22 and the first end portion 34 of the first support member 26. The transverse butt weld is formed by abutting two elements such as at the edges 90,98 of the top plate and first support member and forming a groove 178, such as the V-shaped groove shown, into which the welding material is applied. The first weld 106 is a double transverse butt weld in which a weld is applied to grooves on both sides of the plates to be welded one to the other. The second 108, third 110, fourth 112, ninth 174 and tenth 176 welds are also preferably double transverse butt welds. The fifth 114, sixth 116, seventh 118, and eighth 119 welds are single transverse butt welds, also described as longitudinal bevel welds, made without a backup and formed with only a single weld groove in order to join the first and second side plates 30,32 to the skeleton structure 66.

It should be understood that the load carrying structure 10, and particularly the configuration of the plates, support member and welds and the locations of the load input locations, can differ as is known in the art without departing from the invention. The support members as disclosed can be replaced by tubular members which extend between and are connected to the side plates 30,32. Plate sections of greater width can then be used, such as is shown relative to the outwardly extending portions 78,80 of the side plates, to increase the section properties in the areas adjacent the tubular members. Elements of the load carrying structure, such as, for example, the skeleton structure 89, can also be forged or cast to further provide desirable properties in the structure, as is known in the art.

Industrial Applicability

The preferred method of making the disclosed embodiment of the load carrying structure 10 lends itself to improved inspection procedures and a more uniform product. First, the first and second end portions 38,46 of the top plate 22 are connected to the first end portions 36,42 of the first and second support members 26,28, respectively, and the first and second end portions 40,48 of the bottom plate 24 are connected to the second end portions 36,44 of the first and second support members, respectively. This forms the open sided skeleton assembly 89 (FIG. 2) which permits the use of welds from both sides to connect the elements, as well as visual, ultrasonic or other inspection of the welds from both inside and outside of the structure.

The next step involves positioning the first and second side plates 30,32 relative to and in contact with the skeleton assembly 89 at a location generally along said skeleton assembly and also with portions extending outwardly from the skeleton assembly adjacent the first support member 26. The first and second side plates are then connected by welding to the first and second edge portions 38,46;40,48, respectively, of the top and bottom plates 22,24 and to the first and second side portions 58,60;62,64, respectively, of the first and second support members 26,28.

One of the important steps in assemblying a welded structure such as the load carrying structure 10 is to maintain uniform welds and satisfactory manufacturing tolerances. In making the skeleton assembly 89, the respective edges 90,92;94,96 of the top and bottom plates 22,24 and the respective edges 98,100; 102,104 of the first and second support members 26,28 are preferably machined to establish preselected dimensions of the top and bottom plates and the first and second support members. By doing this prior to placing the related edges in abutting relationship, a uniform skeleton assembly can be efficiently and simply constructed. Machining of the edge portions 50,52;54,56 of the top and bottom plates 22,24 is also desirable prior to locating the first and second side plates in contact with said top and bottom plates.

It will be readily seen that configurations of the load carrying structure 10 yield themselves to a uniform and convenient method of fabrication by assembly, such as by clamping, of simple subassemblies and by eliminating discontinuities along related adjoining elements. For example, castings (representing the first and second support members 26,28) are not an "add on" to the structure but rather an integral part of the skeleton assembly 89 shown, which acts as a "fixture" to which side plates are simply and securely attached during manufacturing by a continuous, uniform weld. Prior machining of the weld surfaces eliminates back up type welding, which can create stress risers and requires additional elements or a more complicated configuration to provide the weld back up. Also, as noted previously, related edges or sides of the various elements are connected in abutting relationship by butt welding which technique adds further favorable stress characteristics to the structure.

The section properties of the load carrying structure are also controlled to provide load carrying characteristics, particularly with respect to the load input locations. For example, support members and support ears useable with the basic box structure 82 are generally castings to provide a higher area moment of inertia in a compact space at the various load input locations. The step of connecting the wider first plate portions 158;160 to their related second plate portions 160;164 of the side plates 30,32 also provides a higher area moment of inertia in the area of the first load input location. Further, the relatively widely spaced first plate portions provide sufficient area moment of inertia for the third and fourth load input locations 74,143 in combination with the increased width and the support ears in that portion of the structure.

The various loads encountered on the stick 12 during operation of the excavator are shown, for example, in FIG. 1 for digging with the bucket 16. Bending forces $FB_1$ and side forces $FS_1$, as well as twisting or torsional forces, are exerted at the second load input location 72 by the bucket. At the first load input location 70, reaction forces RB and RS, will respectively occur in response thereto. A bending force $FB_2$ and force $FC_2$ acting as a columnar load will occur at the third load input location 74 owing to forces exerted by the first hydraulic cylinder 18. The second hydraulic cylinder 20 will exert a force at the fourth load input location 143 with reaction forces taken at the bucket and the first, second and fifth load input locations 70,72,144. It will be readily understood by those skilled in the art that additional forces will act upon the stick, such as side bending loads from pin deflection in the various support ears. However, for the purposes of understanding the improved force handling actions of the stick 12, the above-noted forces are sufficient.

In the use of the bucket 12, the reaction to the forces $FB_1$,$FS_1$, exerted through said bucket occur substantially at the first point of connection of the stick to an external element, which is the first load input location 70. Thus, it will be seen that the box structure 82 through the boom-stick pivot point resists the most severe loads on the stick which result from the complex forces encountered by the bucket. The box structure is also the most rigid portion of the stick, as well as the portion with the highest area moment of inertia and therefore it is positioned at the most favorable location from a structural standpoint to resist the bending and torsional loads from the bucket. On the other hand, the forces at the third and fourth load input locations 74,142 are relatively less, particularly the loads which create torsional forces at such points. The spaced apart outwardly extending portions 78,80 of the side plates 30,32 are sufficient to handle the primarily columnar and bending loads without the need for resisting strong torsional forces. This reduces overall weight of the structure by reducing the need for a casting at these points, plus it permits better access for welding of the first support member 26 or casting to the inner sides 113,115 of the side plates.

The load carrying structure 10 therefore is designed for ease in manufacture, plus uniform welds with few discontinuities in the finished structure. The structure also effectively carries loading encountered in operation by being designed to carry the torsional loads and higher bending loads through the box structure 82 while resisting the columnar loads and lessening bending loads across the spaced apart outwardly extending plate structure. Further, effective life of the load carrying structure can be increased by increasing the thickness of the elements, particularly the plates, of the structure.

Other aspects, objects and advantages will become apparent from a study of the specification, drawings and appended claims.

What is claimed is:

1. A load carrying structure (10), comprising:

top and bottom plates (22,24) each having first and second edge portions (50,52;54,56) and first and second end portions (38,46,40,48);

first and second side plates (30,32) connected to said first and second edge portions (50,54;52,56), respectively, of both of said top and bottom plates (22,24) and each extending outwardly from and adjacent said first end portions (38,40) of said top and bottom plates (22,24), said outwardly extending portions (78,80) of said first and second side plates (30,32) being spaced one from the other;

first and second support members (26,28) each having first and second side portions (58,60;62,64) and first and second end portions (34,36;42,44), said first support member (26) being connected at its first and second end portions (34,36) to said first end portions (50,52) of said top and bottom plates, respectively, and at its first and second side portions (58,60) to said first and second side plates (30,32), respectively, said second support member (28) being connected at its first and second end portions (42,44) to said second end portions (46,48) of said top and bottom plates (22,24), respectively, and at its first and second side portions (62,64) to said first and second side plates (30,32) respectively; and at least first, second and third preselected load input locations (70,72,74), said first and second load input locations (70,72) each being defined on said first and second side plates (30,32) and with said first and second support members (26,28), respectively, said third load input location (74) being defined on said outwardly extending portions (78,80) of said first and second side plates (30,32).

2. The load carrying structure (10), as set forth in claim 1, wherein said first and second support members (26,28) are connected to said top and bottom plates (22,24) by double transverse butt welds (106,108, 110,112).

3. The load carrying structure (10), as set forth in claim 1, wherein said first and second side plates (30,32) each have an inner side (113,115) and are positioned in abutting relationship at said inner sides (113,115) with said first edge portions (50,54) and said second edge portions (52,56), respectively, of the top and bottom plates (22,24) and said first and second side plates (30,32) are connected to said top and bottom plates (22,24) by welds (114,116,118,120) along said related abutting inner sides (113;115) and first and second edge portions (50,54;52,56).

4. The load carrying structure (10), as set forth in claim 3, wherein said welds (114,116,118,120) are single transverse butt welds.

5. The load carrying structure (10), as set forth in claim 1, wherein at least one of said first support member (26) and said second support member (28) is connected to at least one of said top plate (22) and said bottom plate (24) at a location between said first and second load input locations (70,72).

6. The load carrying structure (10), as set forth in claim 1, wherein said first and second side plates (30,32) each have first and second plate portions (158,160;162,164), said first plate portions (158,162) defining said first load input location (70) and said third load input location (74) and each having an area moment of inertia greater than about the related one of said second plate portions (160,164), said second plate portions (160;164) defining said second load input location (72).

7. The load carrying structure (10), as set forth in claim 6, wherein said first and second plate portions (158,160;162,164) each have edges (166,168,170, 172), said edges (166,168;170,172) of related first and second plate portions (158,160;162,164) being positioned in abutting relationship and connected one to the other by welds (174,176) at said abutting locations.

8. The load carrying structure (10), as set forth in claim 6, wherein each of said first and second plate portions (158,160;162,164) has a width ($W_1$,$W_2$,$W_3$,$W_4$), said widths ($W_1$;$W_3$) of said first plate portions (158; 162) each being greater than about the widths ($W_2$;$W_4$) of the related one (160;164) of the second plate portions (160,164).

9. The load carrying structure (10), as set forth in claim 1, wherein said first and second side plates (30,32) each have first and second openings (120,130;121,132), said first and second support members (26,28) each have an opening (121,134), and said first load input location (70) is defined by portions of said first and second side plates (30,32) defining the respective first openings (120,121) of said first and second side plates (30,32) and portions of said first support member (26) defining said opening (122) of said first support member (26), and said second load input location (72) is defined by portions of said first and second side plates (30,32) defining the respective second openings (130,132) of said first and second side plates (30,32) and portions of said second support member (28) defining said opening (134) of said second support member (28).

10. The load carrying structure (10), as set forth in claim 1, wherein said outwardly extending portions (78,80) of said first and second side plates (30,32) each have a first opening (82,84) and said third preselected load input location (74) is defined by portions of said first and second side plates (30,32) defining said respective first openings (82,84) of said outwardly extending portions (78,80).

11. The load carrying structure (10), as set forth in claim 1, including a longitudinal axis (146) and a fourth preselected load input location (142) and wherein said first, second and third load input locations (70,72,74) are positioned generally along said longitudinal axis (146) and said fourth preselected load input location (142) is defined by said outwardly extending portions (78,80) of said first and second side plates (30,32) and positioned at a location spaced from said longitudinal axis (146) and generally adjacent said first load input location (70).

12. A load carrying structure (10), comprising:

a skeleton assembly (89) having top and bottom plates (22,24) and first and second support members (26,28), said top and bottom plates (22,24) each having first and second end portions (38,46;40,48) and first and second edge portions (50,52;54,56), said first support member (26) having first and second end portions (34,36) and first and second side portions (58,60) and being connected at said first end portion (34) to said first end portion (38) of said top plate (22) and at said second end portion (36) to said first end portion (40) of said bottom plate (24), said second support member (28) having first and second end portions (42,44) and first and second side portions (62,64) and being connected at said first end portion (42) to said second end portion (42) of said top plate (22) and at said second end portion (44) to said second end portion (48) of said bottom plate (24);

first and second side plates (30,32) connected to said first and second edge portions (50,54;52, 56), respectively, of both said top and bottom plates (22,24) and to said first and second side portions (58,62;60,64), respectively, of both of said first and second support members, and each extending outwardly from and adjacent the first support member (26), said outwardly extending portions (78,80) of said first and second side plates (30,32) being spaced one from the other; and at least first, second and third preselected load input locations (70,72,74), said first and second load input locations (70,72) being defined by said first and second support members (26,28), respectively, said third load input location (74) being defined by said outwardly extending portions (78,80) of said first and second side plates (30,32).

13. A method for making a load carrying structure (10) having first and second support members (26,28), top and bottom plates (22,24) and first and second side plates (30,32), comprising:

connecting first and second end portions (38,46) of said top plate (22) to a first end portion (34) of said first support member (26) and to a first end portion (42) of the second support member (28), respectively, and first and second end portions (40,48) of said bottom plate (24) to a second end portion (36) of said first support member (26) and to a second end portion (44) of said second support member (28), respectively, and forming a skeleton assembly (89);

positioning said first and second side plates (30,32) at a preselected location relative to skeleton assembly (89) at a location generally along said skeleton assembly (89) and extending outwardly from said skeleton assembly (89) generally adjacent said first support member (26); and connecting said first and second side plates (30,32) to first edge portions (50,54) and second edge portions (52,56), respectively, of both the top and bottom plates (22,24) and to first side portions (58,62) and second side portions (60,64), respectively, of both the first and second support members (26,28) at said preselected location.

14. The method, as set forth in claim 13, wherein said first and second side plates (30,32) are connected to said top and bottom plates (22,24) and said first and second support members (26,28) by welding.

15. The method, as set forth in claim 13, including the step of locating an inner side (113,115) of each of the first and second side plates (30,32) in abutting relationship with said related first and second edge portions (50,52;54,56), of said top and bottom plates (22,24) and the related first and second side portions (58,60,62,64), of said first and second support members (26,28) when performing step 2 and wherein the connections of step 3 are performed by single transverse butt welding along said related abutting edges (50,54; 52,56) and said inner sides (113;115).

16. The method, as set forth in claim 13, wherein said first and second end portions (38,46;40,48) of said top and bottom plates (22,24) each have edges (90,92;94,96) and said first and second end portions (34,36;42,44) of said first and second support members (26,28) each have edges (98,100;102,104) and including the step of positioning related edges (90,98;92,100; 94,102;96,104) in abutting relationship one related edge with the other prior to performing step 1.

17. The method, as set forth in claim 16, wherein the connections of step 1 are performed by welding along said related abutting edges (90,98;92,100; 94,102;96,104).

18. The method as set forth in claim 17, wherein said welding is performed by transverse butt welding.

19. The method, as set forth in claim 13, including the step of machining said edges (90,92;94,96) of said first and second end portions (38,46;40,48) of said top and bottom plates (22,24) and said edges (98,100,102,104) of said first and second support members (26,28) and establishing preselected dimensions of said top and bottom plates (22,24) and first and second support members (26,28) prior to performing step 2.

20. The method, as set forth in claim 13, including the step of machining said first and second edge portions (38,46;40,48) of both said top and bottom plates (22,24) prior to performing step 1.

21. The method, as set forth in claim 13, including the step of connecting respective first and second plate portions (158,160;162,164) one to the other and forming said first and second side plates (30,32).

22. The method, as set forth in claim 13, including the step of forming at least first, second and third preselected load input locations (70,72,74) on said load carrying structure (10).

* * * * *